US007155829B1

(12) United States Patent
Sun

(10) Patent No.: US 7,155,829 B1
(45) Date of Patent: Jan. 2, 2007

(54) ART DESIGN KNIFE

(76) Inventor: Fu-Cheng Sun, No. 126, Pao Chung Road, Hsin Tien City, Taipei Hsien (TW)

( * ) Notice: Subject to any disclaimer, the term of this patent is extended or adjusted under 35 U.S.C. 154(b) by 0 days.

(21) Appl. No.: 11/242,034

(22) Filed: Oct. 4, 2005

(51) Int. Cl.
*B26B 3/00* (2006.01)

(52) U.S. Cl. ..... 30/162; 30/2; 30/125

(58) Field of Classification Search ..... 30/125, 30/162.2, 164, 331, 335, 336, 338, 342, 314; 7/118; D8/107, 99
See application file for complete search history.

(56) References Cited

U.S. PATENT DOCUMENTS

| | | | | |
|---|---|---|---|---|
| 3,577,637 | A * | 5/1971 | Braginetz | 30/162 |
| 4,517,741 | A * | 5/1985 | Castelluzzo | 30/162 |
| 5,005,290 | A * | 4/1991 | Gilbert | 30/162 |
| 5,042,154 | A * | 8/1991 | Gilbert | 30/162 |
| 6,233,830 | B1 * | 5/2001 | Lamond et al. | 30/123 |
| 6,349,473 | B1 * | 2/2002 | Schmidt | 30/162 |
| 6,971,178 | B1 * | 12/2005 | Rowlay | 30/162 |
| 2003/0196331 | A1 * | 10/2003 | Ho | 30/162 |
| 2004/0045172 | A1 * | 3/2004 | Rowlay | 30/162 |
| 2006/0010694 | A1 * | 1/2006 | Chen et al. | 30/162 |
| 2006/0080842 | A1 * | 4/2006 | Schmidt | 30/162 |
| 2006/0130339 | A1 * | 6/2006 | Berns | 30/162 |

* cited by examiner

*Primary Examiner*—Boyer D. Ashley
(74) *Attorney, Agent, or Firm*—Rosenberg, Klein & Lee

(57) ABSTRACT

An art design knife structure that includes a case, the case including a left case half and a right case half that are assembled together, a blade frame capable of sliding back and forth disposed within the interior section of the case, and a push button sleeved onto the upper edge at the tail end of the blade frame. The push button projects through a slot hole in the case and, furthermore, the push button consists of two perpendicularly and individually disposed L-shaped push blocks, while the push button is capable of rotating 90 degrees. As such, when cutting objects from the left or the right, the angle and orientation is selectable by an optimal push button direction, the structure of present invention thereby increasing art design knife utility and, furthermore, enhancing their industrial practical value.

1 Claim, 6 Drawing Sheets

ART DESIGN KNIFE

BACKGROUND OF THE INVENTION

1) Field of the Invention

The invention herein relates to an art design knife structure that includes a case, said case consisting of a left case half and a right case half that are assembled together, a blade frame capable of sliding back and forth disposed within the interior section of the case, and a push button sleeved onto the upper edge at the tail end of said blade frame. The push button projects through a slot hole in the case and, furthermore, said push button consists of two perpendicularly and individually disposed L-shaped push blocks, while the push button is capable of rotating 90 degrees. As such, when cutting objects from the left or the right, the angle and orientation is selectable by an optimal push button direction, the structure of present invention thereby increasing art design knife utility and, furthermore, enhancing their industrial practical value.

2) Description of the Prior Art

Art design knives are sharp tools in widespread use that provide for cutting objects. To accommodate various application requirements, numerous art design knives of various shapes have appeared on the market. A conventional art design knife internally holds a trapezoid-shaped blade, said blade typically consisting of a cutting edge along the long bottom side of a trapezoid. When the user pulls the blade outward, the pointed end of the blade extends outside the case and thereby provides for cutting by the user, the user only having to shove a push button to force the blade out the front end of the art design knife.

However, as the manner of using the hand for slicing to the left and the right differs and, furthermore, the object cutting direction similarly varies, when a conventional art design knife is manually utilized for slicing leftward and rightward and the object being cut is placed at different orientations and angles, this results in the shortcoming of extreme manual awkwardness that is often felt and which results in poor cutting action to the extent that the user may even be seriously injured in the process.

In view of the existent drawbacks of the prior art product that still require improvement, the applicant of the invention herein came up with an innovative idea that was extensively researched based on knowledge and design experience gained while engaged in the relevant fields which culminated in the design of the improved structure art design knife herein.

SUMMARY OF THE INVENTION

The objective of the invention herein is to provide an art design knife structure that includes a case, said case consisting of a left case half and a right case half that are assembled together, a blade frame capable of sliding back and forth is disposed within the interior section of the case, and a push button is sleeved onto the upper edge at the tail end of said blade frame; the push button projects through a slot hole in the case and, furthermore, said push button consists of two perpendicularly and individually disposed L-shaped push blocks, while the push button is capable of rotating 90 degrees; as such, when cutting objects from the left or the right, the angle and orientation is selectable by an optimal push button direction, the structure of present invention thereby increasing art design knife utility and, furthermore, enhancing their industrial practical value.

To achieve said objective, the preferred embodiment of the invention herein is accompanied by the brief description of the drawings below and followed by the detailed description of the preferred embodiments to thereby enable the examination committee a further understanding of the advantages, objectives, and capabilities of the present invention.

DETAILED DESCRIPTION OF THE PREFERRED EMBODIMENTS

Figure 1:
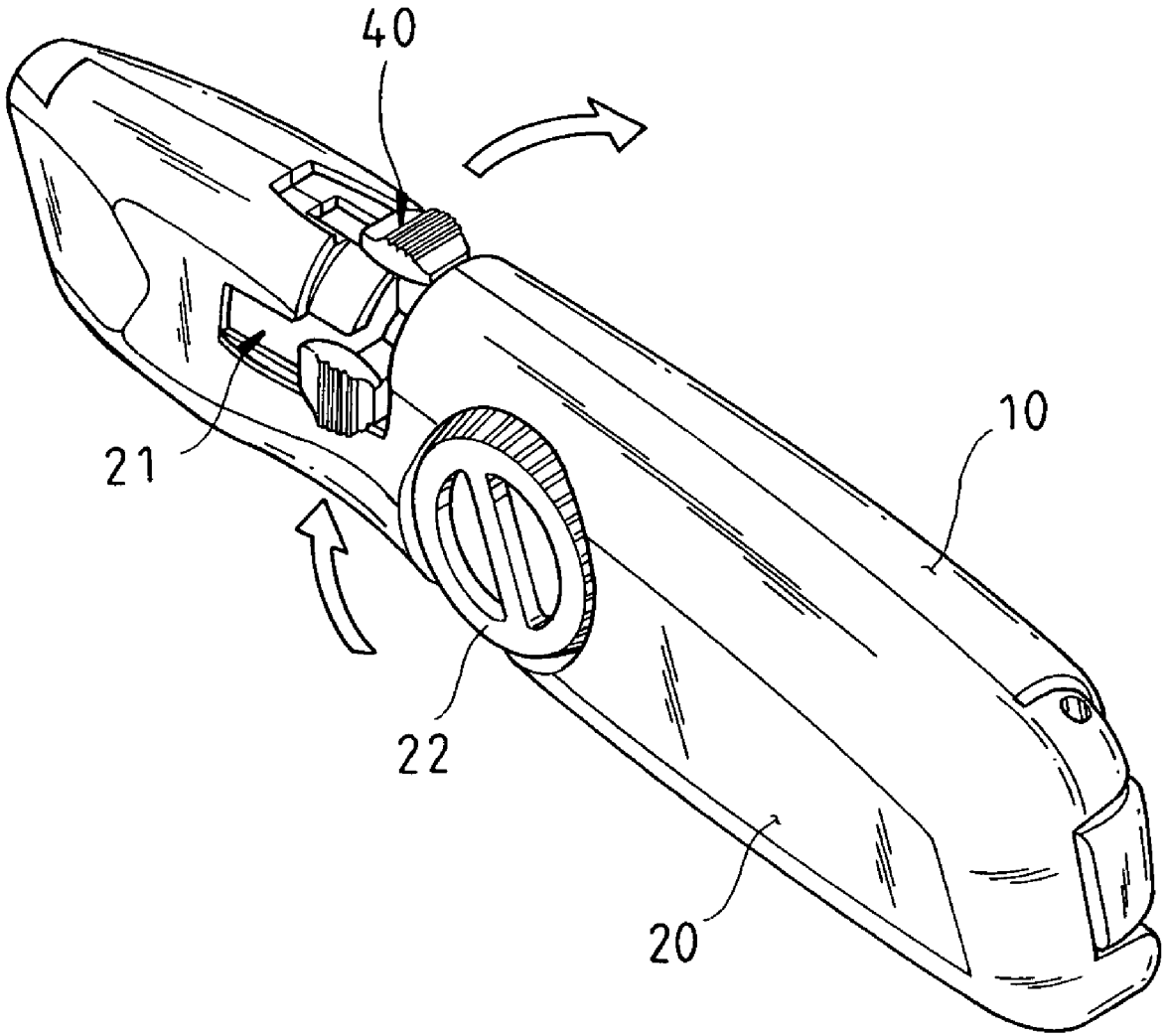
FIG. 1 is an isometric drawing of the invention herein.
Figure 2:
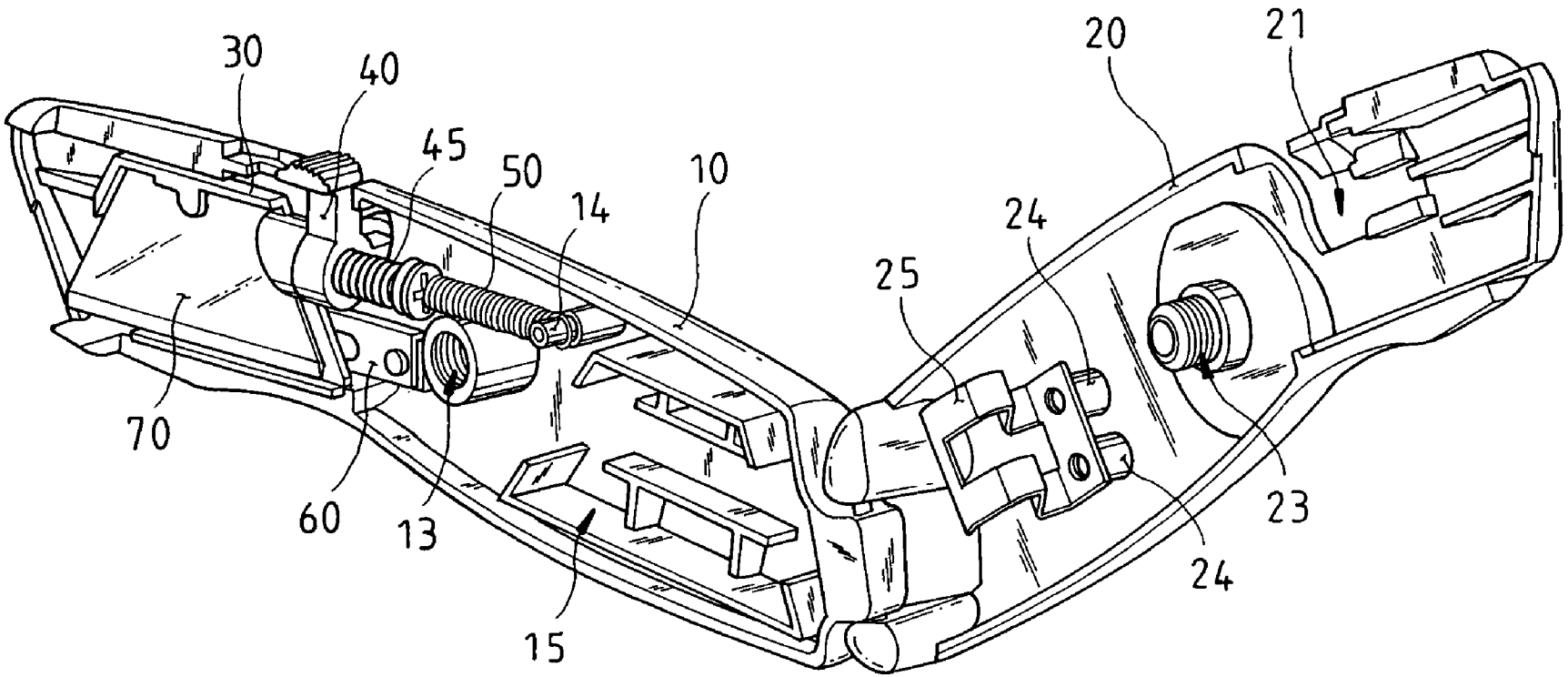
FIG. 2 is an exploded drawing of the invention herein.
Figure 3:
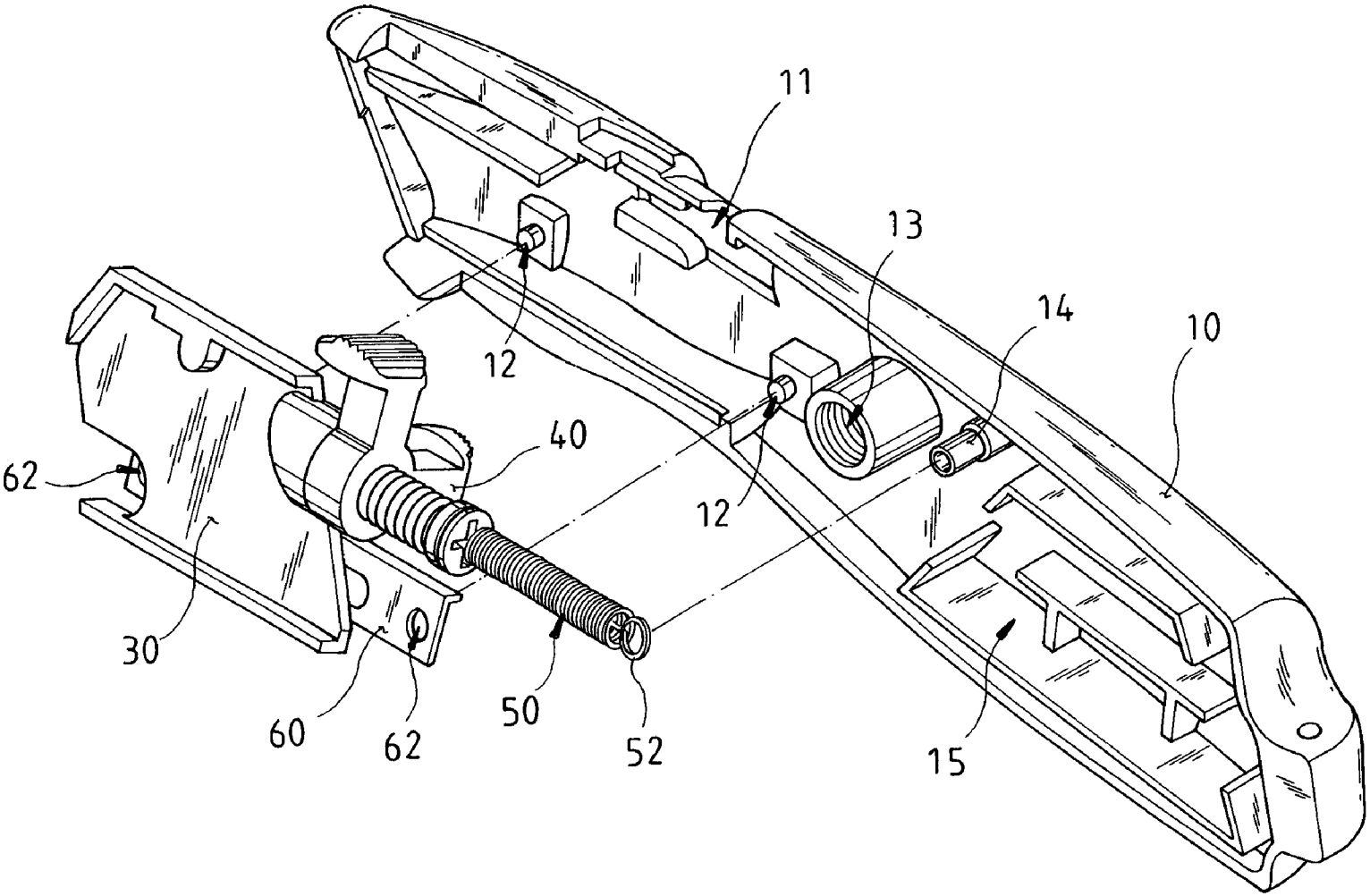
FIG. 3 is an exploded drawing of the blade frame 30 and the left case half 10 of the invention herein.

Referring to FIG. 1 and FIG. 2, the art design knife of the invention herein is comprised of a left case half 10, a right case half 20, a blade frame 30, and a push button 40, wherein:

The left case half 10, referring to FIG. 3, said left case half 10 is a shell plate of one-piece construction having a slot hole 11 reticulated along its anterior upper, lateral edge and two mounting posts 12; additionally, a threaded mounting hole 13 and a post 14 extend from the center section inner edge of the left case half 10 and a trapezoid-shaped blade storage box 15 is disposed at the rear section inner edge of the left case half 10.

The right case half 20, referring to FIG. 1 and FIG. 2, said right case half 20 is a shell plate of one-piece construction having a slot hole 21 reticulated along its anterior upper, lateral edge and a mounting knob 22 inserted at said right case half 20 center section, said mounting knob 22 having a threaded mounting rod 23 extending from its inner side that is aligned with the left case half 10 threaded mounting hole 13; additionally, said right case half 20 also has two mounting posts 24 disposed at the inner edge of its rear section and, furthermore, a flexile spring 25 is sleeved onto said mounting posts 24, and the tail end of said right case half 20 is hinged to the left case half 10.

Figure 4:
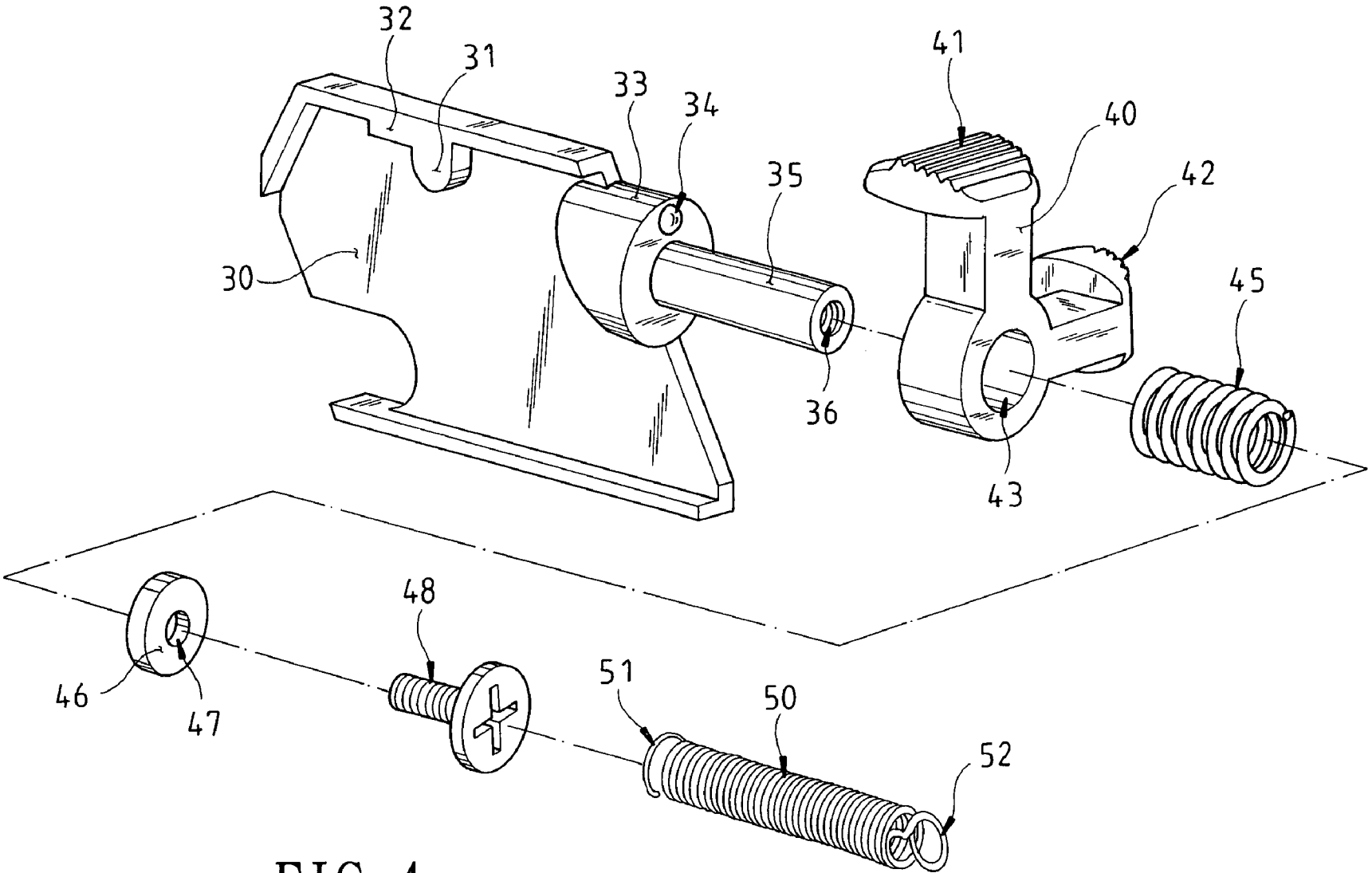
FIG. 4 is an exploded drawing of the blade frame 30 of the invention herein.
Figure 6:
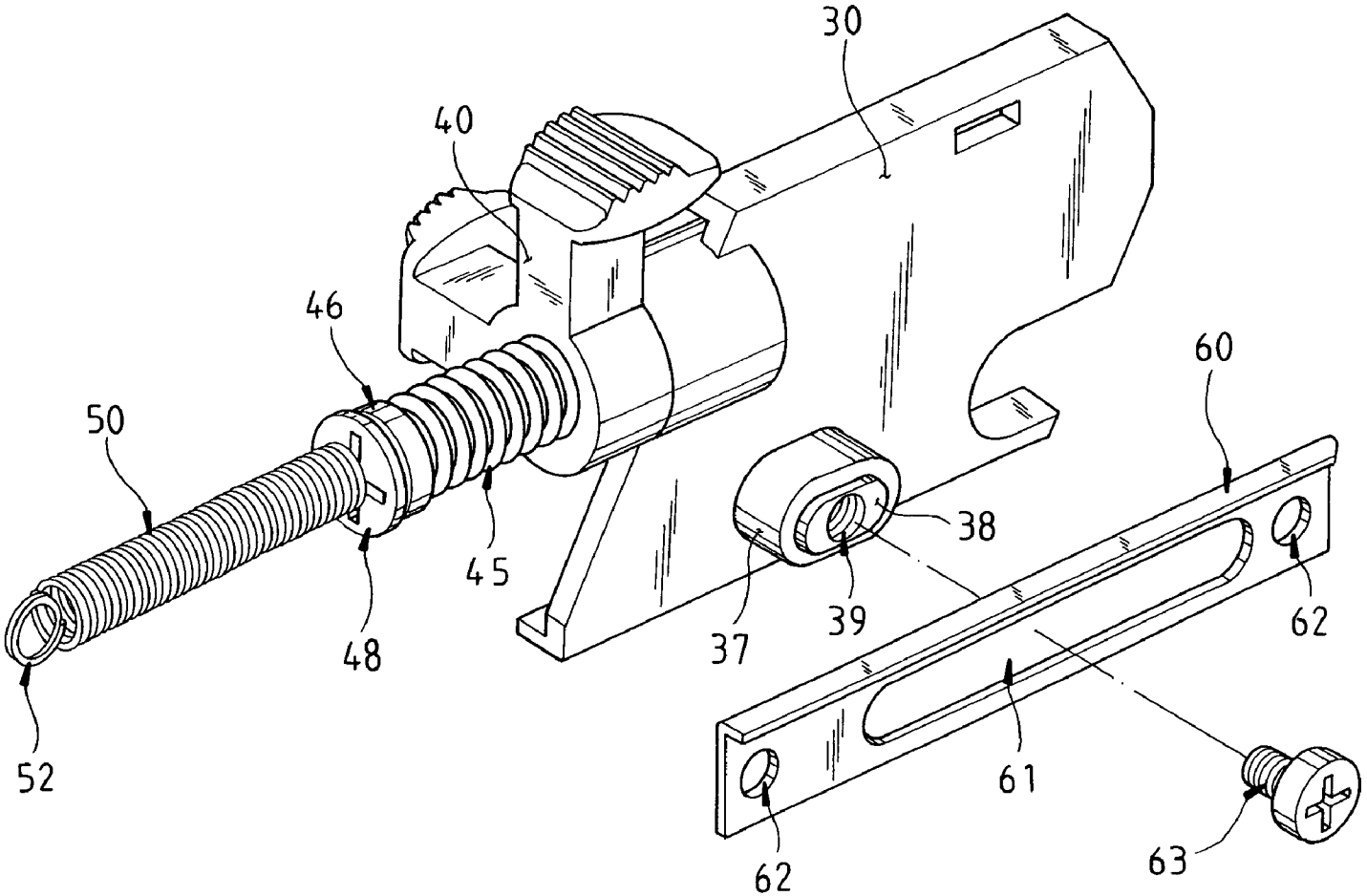
FIG. 6 is an isometric drawing of another side of the blade frame 30 of the invention herein.

The blade frame 30, referring to FIG. 4 and FIG. 6, is a trapezoid-shaped frame in which a semicircular curved mounting tab 31 protrudes from the top edge at one side of the center; said curved mounting tab 31 has an engaging block 32 at one side as well as a columnar push rod 33 that projects from the upper edge at the tail end of said blade frame 30; said push rod 33 consists of a hemispherical locating convexity 34 disposed at the outer side of its top edge and, furthermore, a shank 35 extends from the rear of the push rod 33 and said shank 35 has a threaded hole 36 tapped in one extremity; additionally, said blade frame 30 has a positioning block 37 on the bottom edge at the center of its back side, a slide flange 38 is disposed on the outer side of the positioning block 37, and a threaded hole 39 is tapped in the center of said positioning block 37.

The blade frame 30 slide track 60 is a rectangular, planar element, said blade frame slide track 60 having a elongated hole-shaped slide slot 61 reticulated along its center and, furthermore, said blade frame slide track 60 has a round hole 62 in both its front and rear extremities, and said blade frame slide track 60 is fastened into the threaded hole 39 in the center of the positioning block 37 on the back side of the blade frame 30 by means of a screw 63 inserted through the slide slot 61.

Figure 5:
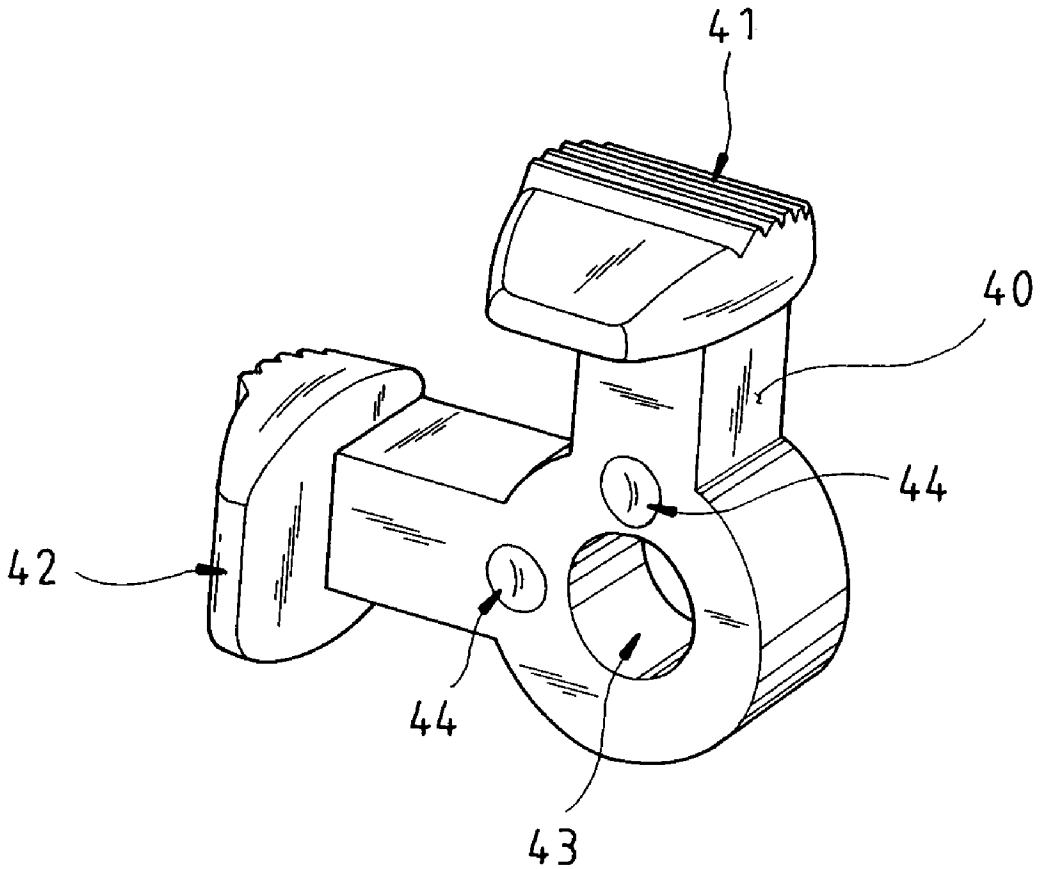
FIG. 5 is an isometric drawing of the push button 40 of the invention herein.

The push button 40, referring to FIG. 4 and FIG. 5, consists of a push block 41 protruding from its top edge, with another push block 42 that protrudes perpendicularly from another side at the top edge of the push block 41; said push button 40 has a round hole through its center and, furthermore, two semicircular concavities 44 along one side of the push button 40. Said push button 40 has a round hole 43 that is movably conjoined onto the shank 35 at the rear end of said blade frame 30 and, at the same time, the semicircular concavities 44 along the bottom edge of the push block 41 at top edge of said push button 41 engage the hemispherical locating convexity 34 on the top edge at the rear end of the blade frame 30, a compression spring 45 is sleeved onto the shank 35 and a draw spring 50, consisting of a hook 51 at one end and a ring 52 at the other, is installed such that the draw spring 50 hook 51 is coupled onto a screw 48, said screw 48 inserted through the hole 47 of a washer 46 and fastened into the threaded hole 36 of the shank 35 at the rear end of the blade frame 30. The round holes 62 in both the front and rear extremities of said blade frame slide track 60 are sleeved onto the left case half 10 mounting posts 12 and, furthermore, the ring 52 of the draw spring 50 at the rear end of the blade frame-30 is slipped onto the left case half 10 post 14; a blade 70 is nested onto the blade frame 30 and the right case half 20 is aligned with the left case half 10, the threaded mounting rod 23 at the inner side of the mounting knob 22 at the center of the right case half 20 is fastened to the threaded mounting hole 13 at the inner side and center of the left case half 10, enabling the complete assembly of the entire art design knife structure.

The art design knife of the invention herein is completed by assembling each of said components, wherein said push button 40 is movably conjoined to the shank 35 at the rear end of the blade frame 30 and, furthermore, the compression spring 45 impels the push button 40 against blade frame 30; additionally, said push button 40 has two semicircular concavities 44 on one side that engage onto the hemispherical locating convexity 34 disposed on the top edge at the rear end of blade frame 30, enabling said push button 40, with the shank 35 serving as the axial center, to rotate 90 degrees clockwise or counter-clockwise such that as the push button 40 is articulated for cutting an object to the left and the right, the angle and orientation relative to the object is selectively determined by the best, appropriate push button direction.

When the invention herein is utilized for cutting, the user shoves the push button 40 forward, causing the blade 70 emerge from the art design knife casing for cutting tasks, and after the hand of the user is removed from the push button 40, the draw spring 50 retracts the blade 70 into the interior section of the casing and, as such, the blade 70 cannot inflict a slashing injury due to user carelessness.

The left case half 10 of the invention herein has the trapezoid-shaped blade storage box 15 that contains a quantity of spare blades such that when a blade 70 in the blade frame 30 becomes worn, the mounting knob 22 is rotatively loosened to release the flexile spring 25 closed between left case half 10 and the right case half 20 to thereby access a replacement blade 70 from the blade storage box 15, and when the flexile spring 25 in the left case half 10 and the right case half 20 is closed, it exerts pressure on spare blades 70 within the blade storage box 15 such that the spare blades are not subject to dislodgment or wear.

In summation of the foregoing section, since the invention herein is capable of achieving the claimed utilization objectives and, furthermore, the disclosed overall structure has exceptional practical value and functionality, the present invention is submitted to the examination committee for review and the granting of the commensurate patent rights.

The invention claimed is:

1. An art design knife comprised of a left case half, a right case half, a blade frame, and a push button, wherein:

said left case half is a shell plate of one-piece construction having a slot hole along its anterior upper, lateral edge and two mounting posts; additionally, a threaded mounting hole and a post extend from a center section inner edge of said left case half and a trapezoid-shaped blade storage box is disposed at a rear section inner edge of said left case half;

said right case half is a shell plate of one-piece construction having a slot hole along its anterior upper, lateral edge and a mounting knob inserted at a center section of the right case half, said mounting knob having a threaded mounting rod extending from its inner side that is aligned with said threaded mounting hole of said left case half; additionally, said right case half also has two mounting posts disposed at an inner edge of its rear section and, furthermore, a flexile spring is sleeved onto said mounting posts, and a tail end of said right case half is hinged to said left case half;

said blade frame is a trapezoid-shaped frame in which a semicircular curved mounting tab protrudes from a top edge at one side of a center; said curved mounting tab has an engaging block at one side as well as a columnar push rod that projects from the top edge a tail end of said blade frame; said push rod including a hemispherical locating convexity disposed at an outer side of its top edge and, furthermore, a shank extends from a rear of the push rod and said shank has a threaded hole tapped in one extremity; additionally, said blade frame has a positioning block on a bottom edge at the center of its back side, a slide flange is disposed on a outer side of said positioning block, and a threaded hole is tapped in the center of said positioning block;

said blade frame has a slide track that is a rectangular, planar element, said blade frame slide track having a elongated hole-shaped slide slot along its center and, furthermore, said blade frame slide track has a round hole in both its front and rear extremities, and said blade frame slide track is fastened into said threaded hole in the center of said positioning block on the back side of said blade frame by means of a screw inserted through said slide slot;

said push button consists of a push block protruding from its top edge, with another push block that protrudes perpendicularly from another side at the top edge of said push block; said push button has a round hole through its center and, furthermore, two semicircular concavities along one side of said push button; said push button has a round hole that is movably conjoined onto said shank at a rear end of said blade frame and, at the same time, said semicircular concavities along the bottom edge of said push block at top edge of said push button engage said hemispherical locating convexity on the top edge at the rear end of said blade frame, a compression spring is sleeved onto said shank and a draw spring, including a hook at one end and a ring at the other, is installed such that said hook of said draw spring is coupled onto a screw, said screw inserted through a hole of a washer and fastened into said threaded hole of said shank at the rear end of said blade frame, said round holes in both the front and rear extremities of said blade frame slide track are sleeved onto said left case half mounting posts and, furthermore, said ring of said draw spring at the rear end of said blade frame is slipped onto said left case half post; a blade is nested onto said blade frame and said right case half is aligned with said left case half, said threaded mounting rod at the inner side of said mounting knob at the center of said right case half is fastened to said threaded mounting hole at the inner side and center of said left case half, for assembly of the art structure.

* * * * *